United States Patent [19]

Jones

[11] 4,205,948

[45] Jun. 3, 1980

[54] PERISTALTIC PUMP

[76] Inventor: Allan R. Jones, 51 Badajoz Rd., 2112 Ryde, New South Wales, Austria

[21] Appl. No.: 874,090

[22] Filed: Feb. 1, 1978

[30] Foreign Application Priority Data

Feb. 10, 1977 [AU] Australia ..... PC9031

[51] Int. Cl.[2] ..... F04B 43/12; F04B 45/08

[52] U.S. Cl. ..... 417/477

[58] Field of Search ..... 417/475, 476, 477

[56] References Cited

U.S. PATENT DOCUMENTS

| | | | |
|---|---|---|---|
| 2,018,999 | 10/1935 | De Bakey et al. | 417/477 |
| 2,035,159 | 3/1936 | Henry | 417/476 X |
| 2,679,807 | 6/1954 | Bruckman | 417/476 X |
| 2,826,993 | 3/1958 | McChesney | 417/476 X |
| 2,988,001 | 6/1961 | D'Arcey et al. | 417/476 X |
| 3,358,609 | 12/1967 | Worth et al. | 417/477 |
| 3,463,092 | 8/1969 | Meyer | 417/477 |
| 3,816,035 | 6/1974 | Malbec | 417/477 |

FOREIGN PATENT DOCUMENTS

| | | | |
|---|---|---|---|
| 2153052 | 5/1973 | Fed. Rep. of Germany | 417/476 |

*Primary Examiner*—Richard E. Gluck

*Attorney, Agent, or Firm*—Ladas, Parry, Von Gehr, Goldsmith & Dechamps

[57] ABSTRACT

A peristaltic pump composed of a tubular cylindrical housing closed at opposite ends, a flexible tube wound in single and complete helix circumferentially around the inner wall of said housing with its opposite end portions passing outwardly through two substantially coplanar and tangentially disposed ports in the housing, a rotatable assembly axially disposed within the housing and carrying at least one radially displaceable roller, linearly slidable setting bar means within said rotatable assembly operable to extend said roller into compressive contact with the helix of tubing, and power means for rotating said assembly to cause said roller to traverse said helix to force fluid content of said tubing along same.

6 Claims, 6 Drawing Figures

PERISTALTIC PUMP

This invention relates to peristaltic pumps of the kind utilizing a single and complete coil, or helix, of flexible tubing compressively engaged by roller means acting within said helix for the advancement of a fluid content of the tubing, and more particularly to such a pump incorporating provision for radial extension and withdrawal of said roller means.

Existing pumps of this nature invariably achieve a pulsating flow of fluid content which in many applications, such as in the case of surgical and metering pumps, is undesirable. In some instances contemporary peristaltic pumps are unreliable due to frequent frictional wear and resulting damage to the flexible tubing, and in most instances major disassembly is required for replacement of the tubing.

Additionally, the full useful potential of peristaltic pumps has not been utilized due to the lack of any pump of this type being provided in a modular form capable of assembly with similar modules in a bank of independent operable pumps deriving a common power drive.

BACKGROUND OF THE INVENTION

Peristaltic pumps in one known form comprise a cylindrical housing for a flexible resilient tube entering at one point on the circumference thereof and extending around the interior of the housing for approximately 260° to exit at another point on the housing substantially confronting the entry point. A roller is forced into compressive engagement with the tube and rotated by gear means on the axis of the housing to provide the means for drawing a fluid substance in through one end of the tube and forcing it around the tube to the outlet by progressively compressively collapsing the tube. By the provision of a restriction at the outlet side of the pump and the rotation of the roller at a relatively high speed the fluid substance can be pumped out of the tube at a higher pressure than that derived from its source. In another known form the tube has been positioned within the housing to circumscribe a complete helix with its inlet and outlet end portions extending substantially tangentially with respect to the cylindrical housing. Both forms of pumps have not been satisfactory for the many applications requiring substantially uniform flow of fluid, i.e. as opposed to a pulsating flow. It can be readily appreciated that such decompressurization of the fluid substance can in fact induce reverse flow thus requiring a non-return or check valve to be installed to avoid such unwarranted and dangerous effect if the pump is being utilized for surgical purposes, such as blood transfusion.

SUMMARY OF THE INVENTION

It is the principal object of the invention to provide a pump of the peristaltic type which is substantially free from at least some of the above defects.

In accordance with the invention there is provided a peristaltic pump comprising a housing defining a cylindrically walled chamber, a flexible tube wound in a single helix within and around the cylindrical wall of the housing, a rotatable roller within the chamber and outwardly radially displaceable to bear upon the tube to compress same against said cylindrical wall of the housing, a linearly displaceable setting bar movable through the housing to effect outward displacement of said roller, drive means for angularly displacing said roller around the inner circumference of the helix of the tube, and means for rotating said roller about its axis to cause it to roll over said tube during its passage around said helix.

The invention will now be described with reference to several preferred embodiments shown in the accompanying drawings, in which:

FIG. 1 is an exploded perspective of a first embodiment;

FIGS. 2*a* and 2*b* when assembled end-on-end as indicated depict an exploded perspective of a second embodiment composed of a bank of juxtaposed pumps;

Figure 1:
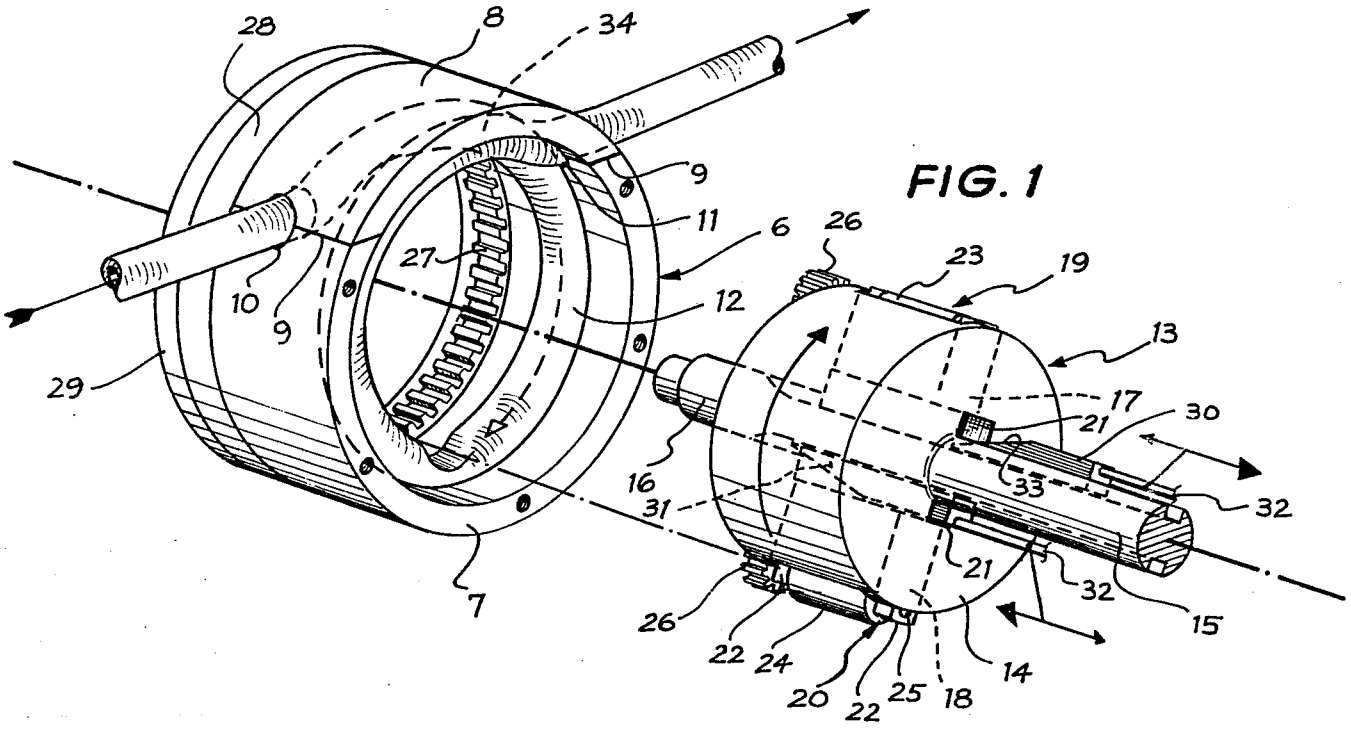

The embodiment of FIG. 1 consists of a body 6 in the form of a tubular cylindrical housing 7 which has an upper cap or cover 8 fixed by any suitable means, such as screws (not shown), to the upper portion of the housing. The join line 9 between the two parts of the housing 7 is in a plane passing approximately diametrally through inlet and outlet passages 10 and 11 in the upper half of the housing. A length of silicon elastomer flexible resilient tubing 12 is entered through the inlet passage 10 and coiled in a single complete helix in contact with the inner wall of the housing 7 and passes out through the outlet passage 11. It will be noted that the two external end portions of the tubing are in approximately the same plane which is a substantial tangent to the inner cylindrical wall of the housing 7.

A core member 13, functioning as a roller support assembly, is axially entered into the housing 7 and consists of a cylindrical plug 14 bored along its axis to accept a shaft 15. A forward end 16 of the shaft 15 may be provided with suitable facility (not shown) for deriving power drive for the core member 13. The shaft 15 is preferably splined or keyed to the plug 14 so that the two rotate in unison. Two diametrally opposed radial slots 17 and 18 are cut in the plug 14 for slidable housing of individual roller assemblies 19 and 20. Each assembly 19 or 20 comprises a substantially rectangular plate having bearing bars 21 at their inner ends and a pair of forked arms 22 at their outer ends. Individual rollers 23 and 24 are rotatably supported on spindles 25 supported between respective pairs of arms 22. Each spindle 25 is extended to one sided fixed to a pinion 26.

When the core member 13 is entered into the housing 7 the pinions 26 confront a ring gear 27 secured to one end of the housing 7. The ring gear 27 is preferably a separable annulus 28 held to the end of the housing 7 by an end plate 29. A further end plate (not shown) may be fixed over the other end of the housing 7 to retain the core member 13 therein.

It is a feature of this invention that the rollers 23 and 24 together with their entire assemblies 19 and 20 are extensible and retractible within their enclosing plug 14. As shown in FIG. 1 such radial movement is effected by sliding keys 30 and 31 which are secured by linkages 32 to control means for extending and withdrawing them along keyways provided in the shaft 15. It can be seen that with extension into the plug 14 of either key 30 or 31 its forward ramp-shaped surface 33 will cause the respective roller assembly at 19 or 20 to be readily extended. As the rollers are positioned adjacent and within the confines of the helix of the tubing 12, either roller 19 or 20 when extended will compress the tube 12 against the inner surface of the housing 7. Drive on the shaft 15 will then cause the extended roller to progressively traverse the helix thereby forcing any fluid content along the tube towards its outlet while drawing fluid from its source. It is a further feature of this invention that the two rollers shown in FIG. 1, being driven by reciprocating keys 30 and 31 always driven 180° out of phase provide an "exchanging roller" facility in that as one roller 23 extends the other roller 24 retracts. Providing that the exchanging feature is kept precisely 180° out of phase it will be possible to obtain a fluid content flow from the pump which is substantially uniform, i.e. non-pulsating. Preferably, the retraction of each roller in turn during its traverse of the helix commences to occur immediately preceding the crossover point 34 in the helix of the two end portions of the tubing 12 and is complete at the central part of this crossover and then commences to extend progressively towards the far side of the crossover point 34. The linkages 32 connected to the keys 30 and 31 may be hydraulically or mechanically controlled, according to the user's requirements.

Figures 2A, 3:
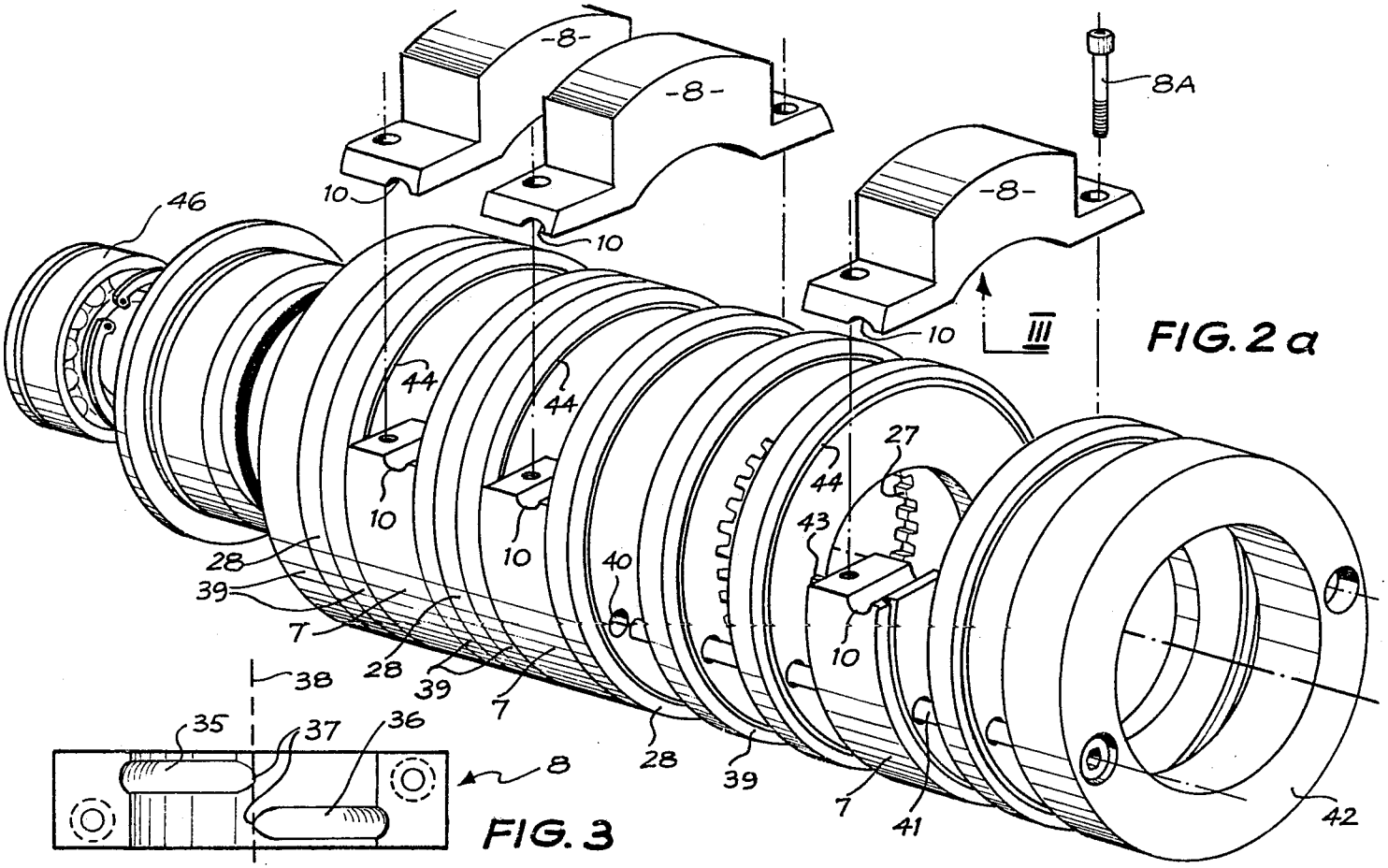
FIG. 3 shows in inverted plan the internal shaping of a cover plate for use in the pump of FIG. 1 or any one of the pumps shown in the bank of FIGS. 2*a* and 2*b;*

As an alternative to the embodiment of FIG. 1 a single roller assembly 19 or 20 may be provided in the plug 14 and reasonably non-pulsating fluid flow achieved if the cap 8 on the housing 7 should be provided with internal grooving for accommodation of the end portions of the tubing 12 such as that shown in FIG. 3. The juxtaposed grooves 35 and 36 are staggered as shown and become progressively shallower towards their inner ends 37. It is desirable that the ends 37 of the two grooves occur in the same transverse plane 38 of the cap 8 to avoid any overlap of these grooves. Thus, the single roller assembly 17 utilized in this form will not require to be radially retracted during traversing around the helix. Nevertheless, retractability thereof is still provided for the following purpose.

Apart from the facility of substantially uniform fluid content flow retractability of the roller assemblies 17 and 18, regardless of whether one, two or more such assemblies are provided in any pump, enables all roller assemblies 17 to be retracted simultaneously for simplicity of replacement of a tubing 12 in the event of either damage thereto or replacement of a different capacity tubing. The replacement may be readily made by removal of the cap 8 and retraction of the rollers. In order to retain retraction of the rollers 23 and 24 the linkages 32 may be selectively withdrawn in unison or alternatively the shaft 15, functioning as a setting bar, may itself be withdrawn from the plug 14. For added convenience during replacement of tubing 12 return springs (not shown) may be associated with the roller assemblies 17 and 18 so that they are normally retracted and extended by the keys 30 and 31 against the action of these springs. It will be seen that the power means for linkages 32 to the keys 30 and 31 must be communicated through rotatable couplings as operation of these keys will be required during rotation of the shaft 15, but this will not involve any difficulty.

Provision is also made within the pump of FIG. 1 to avoid slippage of the rollers 23 and 24 on the tubing 12 during traversing around the helix in order to avoid damage through friction therebetween. Furthermore, distortion of the tubing may result from this friction especially when viscous liquids are being pumped. To avoid this the rollers 23 and 24 are controllably rotated by engagement of pinions 26 within the teeth of ring gear 27. It is desirable that the pitch circle diameter of each pinion 26 be equal to the diameter of its respective roller 23 while the pitch circle diameter of the ring gear 27 be equal to the internal diameter of the housing 7 less the dimension equal to twice the wall thickness of the tubing 12. This will then ensure that the tubing 12 is fully closed off during operation of the pump but the closure pressure applied by a roller 23 is insufficient to cause damage to the pump or to the tubing. It will be important that the pitch of the teeth in both the pinion 26 and the ring gear 27 be chosen so that the surface speed of rotation of the roller corresponds with the speed of traverse by the roller of the tube helix.

Figures 2B, 4:
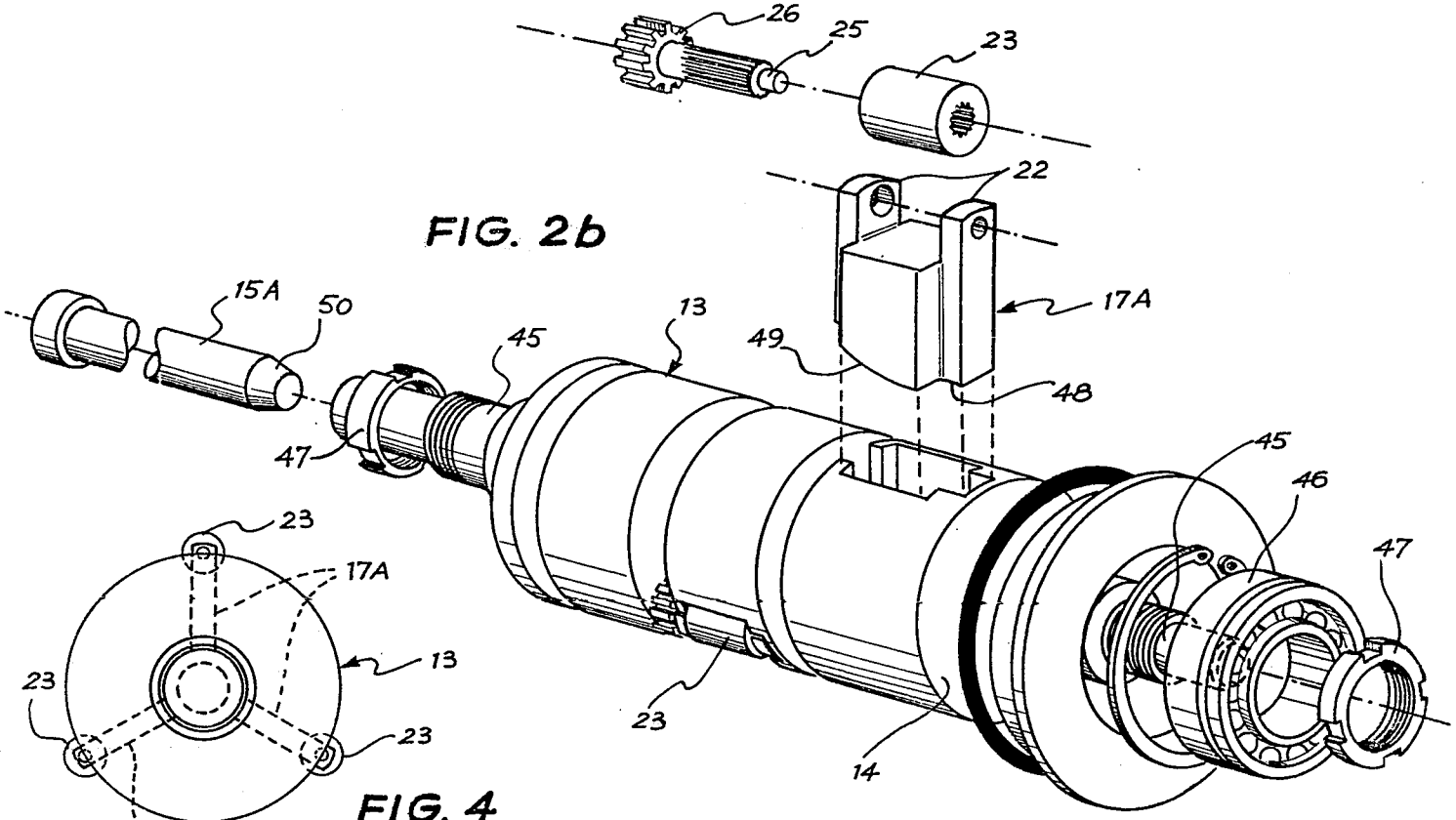
FIG. 4 is an end elevation of the core member of the bank of pumps of FIGS. 2*a* and 2*b.

Reference is now made to the exploded view of FIGS. *2a* and *2b*, and to FIG. 4. In these drawings the same numerals as used above are applied to like parts. The drawing is of an assembly of a plurality of independent modular pumps similar in many respects to that depicted in FIG. 1, excepting that three roller assemblies 17A equally circumferentially spaced are employed, and a single common setting bar 15A passes through the core member 13. Therefore, the "exchanging roller" feature is not incorporated in this embodiment, although by suitable modification the exchanging roller core member 13 of FIG. 1 may be applied. Where a common setting bar 15A is used it will be necessary to utilize for the three separate caps 8 shown in FIG. 2 the form of tapering slots depicted in FIG. 3, if the derived flow of fluid content in the pump tubing 12 is to be non-pulsating.

Three independent modular pumps are illustrated each comprising a tubular cylindrical housing 7 with removable cap 8 secured thereto by screws 8A. The assembled bank of pumps comprises for each pump a housing 7, an annulus 28 containing a ring gear 27 held between two spacer plates 39 adjacent one side of a housing 7. All of the spacers are formed as similar annuluses to the annulus 28 and all plates together with the housing 7 are provided with a pair of mounting holes 40 at diametrally opposite parts of each annulus. A separate threaded rod 41 passes through corresponding holes 40 in register on opposite sides of the assembly and are screwed to a far end plate or spacer 39 provided with a thread in its holes 40 to clamp the assembly together with a forward end plate 32. Preferably, each annulus 28 and spacer 39 as well as housing 7 is provided with a laterally projecting annular rib 43 on one side face and a matching annular groove 44 on the other side so that each adjacent section locks in tongue-and-groove fashion with its neighbouring section.

The setting bar 15A extends through an axial sleeve 45 keyed, or splined, to the plug 14 of the core member 13. Suitable roller races 46 are secured by lock nuts 47 upon opposite ends of the sleeve 45 for support in housings which may be provided by the opposite end plates 39 and 42, or on separate housings (not shown).

The roller assemblies 17A in each of the three separate pumps in the bank terminate at their inner end 48 with an inclined surface 49 facing towards the end of the core member 13 at which the setting bar 15A is inserted. The setting bar 15A has a forward lead-on taper 50 so that with its insertion progressively into the sleeve 45 it engages in turn with the inclined faces 49 of the roller assembly 17A of each pump, successively, to radially extend the sets of rollers per pump into compressive engagement with the tubing 12 within the housing 7 of each pump. Therefore, by selective advancement, or retraction, of the setting bar 15A an increasing or decreasing number of the separate pumps in the bank may be brought into operation without interruption to those pumps already in operation. Such a facility has especial advantage when repair of a single pump may be required, or only selected pumps require to be in operation. These facilities as well as others inherent in this embodiment renders it ideal for industrial application.

Figure 5:
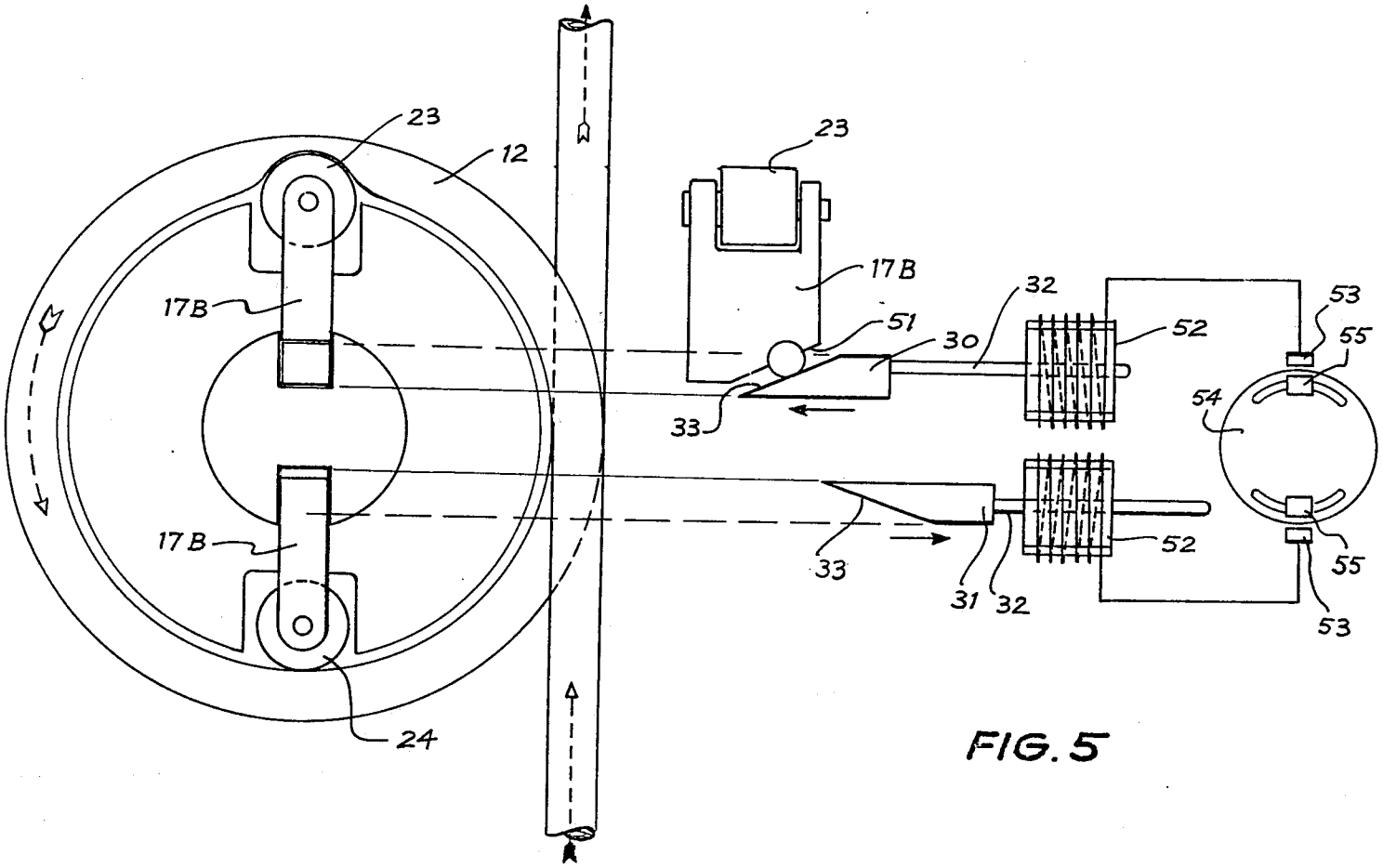
* and FIG. 5 shows partly diagrammatically a third embodiment of a peristaltic pump.

FIG. 5 shows an embodiment of peristaltic pump according to the invention providing for selective electric control of the keys 30 and 31 shown in FIG. 1, or similar types of "exchanging roller" setting bar means. It also is capable of providing for selected degrees of pulsation in the pump flow of fluid content. Like parts have been labelled with similar numerals to those utilized in the foregoing description.

The keys 30 and 31 have similar ramp-like shaped leading edges 33 which bear upon ball bearings or rollers captured between the keys and an inclined underface 51 of the roller assembly 17B. Each key 30 or 31 is actuated through linkage 32 in the form of a plunger operated on by electrical solenoids 52. The coils of these solenoids 52 are electrically wired to slip rings or brushes 53 engaging with a pulse control unit 54. Thus, by positional arrangement of electrical conductors 55 on the pulse control unit 54 energization of the solenoids 52 will be obtained at a predetermined point in the angular rotation of the roller assemblies 17B in order to effect accurate "exchanging roller" functioning in the pump. It can be seen from the drawing that the two sliding keys 30 and 31 are operated 180° out of phase. The pump of this embodiment is ideally suited for chemical applications where metering and controlled pulsing are requirements, for example for analyzing equipment and artificial heart operation.

In the two embodiments shown in FIGS. 1 and 5 it will be preferred that the depth of the teeth both in the pinion 26 and the ring gear 27 is sufficient to permit some radial displacement of the roller assemblies 17 and 18 or 17A without losing mesh between the pinion 26 and the ring gear 27. Furthermore, in all the above-described embodiments it will be possible to create an oil bath within the housing 7 as it is totally enclosed. Alternatively, the interior of the housing 7 may be placed under vacuum. In either instance improved efficiency of the pump can be obtained.

Several embodiments have been described in the foregoing passages but it should be understood that other forms are also possible within the scope of this invention.

What I claim is:

1. A peristaltic pump comprising:

a housing defining a cylindrically walled chamber, a flexible tube for containment of a fluid material wound in a single helix within and around said cylindrical wall of the housing, a core assembly positioned coaxially within said housing, a shaft non-rotatably secured to said core assembly and having keyways, at least two rotatable rollers which are supported within the chamber by said core assembly and are equally spaced circumferentially with respect to said helix, said rollers being radially slidable with respect to said core assembly so as to be outwardly radially displaceable to bear upon the tube to compress same against said cylindrical wall linearly displaceable setting bar means advanceable through the housing to effect outward displacement of said rollers, said setting bar means comprising an individual bar slidable in a respective keyway and associated with each of said rollers, said setting bars being slidable in staggered relationship, drive means for angularly displacing said around the inner circumference of the helix of the tube to cause it to traverse said helix, and means for rotating each said roller about its axis to cause it to roll over said tube during its passage around said helix.

2. A peristaltic pump according to claim 1, wherein said rotating means for said rollers is a pinion rotatable with said rollers and meshing when said roller means are outwardly displaced with a stationary ring gear within said chamber and adjacent to said helix.

3. A peristaltic pump according to claim 2, wherein the pitch diameter of the pinion and of the ring gear and the pitch ratio therebetween is such that the linear surface speed of each roller substantially corresponds to the speed of traverse of said roller around said helix to avoid friction between said roller and said tube.

4. A peristaltic pump according to claim 1, wherein said housing is tubular and closed at its ends by end plates, said tube has inlet and outlet end portions protruding from inlet and outlet ports in the wall of said housing, and said cylindrical wall has a removable sector joined to the remainder of said wall at a junction line which passes through both the inlet and outlet ports, whereby with removal of said sector said tube may be readily withdrawn from said housing.

5. A peristaltic pump according to claim 4, wherein with withdrawal of said setting, bar means from said housing radial retraction of said rollers occurs to provide clearance between said rollers and said housing wall to facilitate said ready withdrawal of said tube.

6. A peristaltic pump according to claim 1, wherein driving means for said setting bars comprises individual plungers and electrical solenoids therefor, said solenoids being energized under control of a stationary adjustable device connected to said solenoids by slip-ring means to provide desired selective operation of said setting bars for control of the degree of pulsation in the pumping of said fluid material.

* * * * *